US006707355B1

(12) United States Patent
Yee

(10) Patent No.: US 6,707,355 B1
(45) Date of Patent: Mar. 16, 2004

(54) GRADUALLY-ACTUATING MICROMECHANICAL DEVICE

(75) Inventor: Ian Y. K. Yee, Austin, TX (US)

(73) Assignee: Teravicta Technologies, Inc., Austin, TX (US)

( * ) Notice: Subject to any disclaimer, the term of this patent is extended or adjusted under 35 U.S.C. 154(b) by 0 days.

(21) Appl. No.: 09/895,286

(22) Filed: Jun. 29, 2001

(51) Int. Cl.[7] ..... H01H 51/22
(52) U.S. Cl. ..... 335/78; 200/181; 200/80
(58) Field of Search ..... 335/78, 80, 124; 200/181, 275, 279, DIG. 42; 333/262; 257/414, 421, 531; 218/146

(56) References Cited

U.S. PATENT DOCUMENTS

| | | | | |
|---|---|---|---|---|
| 4,543,457 | A | | 9/1985 | Petersen et al. |
| 4,959,515 | A | | 9/1990 | Zavracky et al. |
| 5,377,524 | A | | 1/1995 | Wise et al. |
| 5,526,172 | A | | 6/1996 | Kanack |
| 5,544,001 | A | * | 8/1996 | Ichiya et al. ..... 361/233 |
| 5,578,976 | A | | 11/1996 | Yao |
| 5,619,061 | A | | 4/1997 | Goldsmith et al. |
| 5,629,565 | A | | 5/1997 | Schlaak et al. |
| 5,638,946 | A | | 6/1997 | Zavracky |
| 5,673,785 | A | | 10/1997 | Schlaak et al. |
| 5,867,302 | A | | 2/1999 | Fleming |

(List continued on next page.)

OTHER PUBLICATIONS

Hyman et al., "Contact Physics Physics of Gold Microcontacts for MEMS Switches," © 1998 IEEE, pp. 133–140. (No month).

Majumder et al., "Measurement and Modeling of Surface Micromachined, Electrostatically Actuated Microswitches," © 1997 IEEE, pp. 1145–1148. (No month).

Majumder et al., "Study of Contacts in an Electrostatically Actuated Microswitch," © 1998 IEEE, pp. 127–132. No month).

Zavracky et al., "Microswitches and Microrelays with a New Toward Microwave Applications," © 1999 John Wiley & Sons, Inc., pp. 338–347. (No month).

Zavracky et al., "Micromechanical Switches Fabricated using Nickel Surface Micromachining," © 1997 IEEE, pp. 3–9. (No month).

Chalmers, "Relay Races," Jan. 2001, Mechanical Engineering, pp. 66–68.

Hirata et al., "A Micromechanical Switch as the Logic Elements for Circuits in Multi Chip Module on Si (MCM–Si)," 6 pages. (No month).

Petersen, "Silicon as a Mechanical Material," © 1982 IEEE, pp. 420–457. (No month).

Milanovic et al., "Microrelays for Batch Transfer Integration in RF Systems," © 2000 IEEE, pp. 787–792. (No month).

McGruer et al., "Electrostatically Actuated MicroSwitches; Scaling Properties," 1998, pp. 132–135.

*Primary Examiner*—Lincoln Donovan
(74) *Attorney, Agent, or Firm*—Kevin L. Daffer; Conley Rose P.C.

(57) ABSTRACT

In a method for forming a micromechanical device, a force associated with operation of the device is varied between locations spaced across a conductive element of the device. The method may be used to form a switch adapted such that a force associated with actuation of the switch varies between locations spaced across a contact element of the switch. The varied force may include a required closing force for the switch, an applied force during actuation of the switch, a restoring force tending to open the switch, and/or a sticking force tending to keep the switch closed. A variable-valued circuit element having a conductive element and conductive pad may also be formed, adapted such that a fraction of the conductive element which is moved to the proximity of the conductive pad is variable depending on a total magnitude of a force applied.

26 Claims, 12 Drawing Sheets

U.S. PATENT DOCUMENTS 5,994,796 A 11/1999 De Los Santos
6,016,092 A 1/2000 Qiu et al.
6,057,520 A 5/2000 Goodwin-Johansson
6,069,540 A 5/2000 Berenz et al.
6,072,686 A 6/2000 Yarbrough
6,100,477 A 8/2000 Randall et al.
6,100,862 A 8/2000 Sullivan
6,143,997 A 11/2000 Feng et al.
6,153,839 A 11/2000 Zavracky et al.
6,168,395 B1 1/2001 Quenzer et al.
6,183,097 B1 2/2001 Saif et al.
6,188,301 B1 2/2001 Kornrumpf et al.
6,201,629 B1 3/2001 McClelland et al.
6,204,737 B1 3/2001 Ellä
6,212,314 B1 4/2001 Ford
6,307,452 B1 * 10/2001 Sun ..... 333/262
6,433,657 B1 * 8/2002 Chen ..... 333/262

* cited by examiner

GRADUALLY-ACTUATING MICROMECHANICAL DEVICE

BACKGROUND OF THE INVENTION

1. Field of the Invention

This invention pertains to electrical devices including switches and capacitors, and more particularly to a gradually-actuating device which may be used to form switches and/or variable-valued circuit elements.

2. Description of the Related Art

The following descriptions and examples are not admitted to be prior art by virtue of their inclusion within this section.

Microelectromechanical switches, or switches made using microelectro-mechanical systems (MEMS) technology, are of interest in part because of their potential for allowing integration of high-quality switches with circuits formed using integrated circuit (IC) technology. As compared to transistor switches formed with conventional IC technology, for example, MEMS switches may exhibit lower losses and a higher ratio of off-impedance to on-impedance. A persistent problem with implementation of MEMS switches has been the high voltage required (often about 10V or higher) to actuate the switches, as compared to typical IC operating voltages (about 5V or lower).

These relatively high actuation voltages of MEMS switches are caused at least in part by a tradeoff between the closing and opening effectiveness of a given switch design. In the case of a cantilever switch, for example, approaches to lowering the actuation voltage of the switch include reducing the stiffness of the cantilever beam and reducing the gap between the contact element on the beam and the underlying contact pad. Unfortunately, these design changes typically have the effect of making opening of the switch more difficult. MEMS cantilever switch designs generally use an applied voltage to close the switch, and rely on the spring force in the beam to open the switch when the applied voltage is removed. In opening the switch, the spring force, or restoring force, of the beam must typically counteract what is often called "stiction". Stiction refers to various forces tending to make two surfaces stick together, such as van der Waals forces, surface tension caused by moisture between the surfaces, and/or bonding between the surfaces (e.g., through oxidation). In general, modifications to a switch which act to lower the closing voltage also tend to make the switch harder to open, such that efforts to form a switch with a lowered closing voltage can result in a switch which may not open reliably (or at all). It would therefore be desirable to develop a switch design which relaxes the constraints imposed by the above-described tradeoff between opening and closing effectiveness.

SUMMARY OF THE INVENTION

The problems outlined above may be in large part addressed by a method for forming a micromechanical device in which a force associated with operation of the device is varied between locations spaced across a conductive element of the device. The variation in one or more forces across the conductive element of the device may advantageously give rise to a "rolling" motion when the conductive element is brought toward the conductive pad, such that one part of the conductive element comes into the proximity of the pad before other parts do. Such a motion may in some embodiments allow a lower applied force to be used in bringing the conductive element toward the conductive pad than is needed to move a conductive element of similar area which moves "all at once." Alternatively or in addition, the force variation may give rise to a "peeling" motion when the conductive element moves away from the conductive pad, in which one part of the conductive element moves away from the conductive pad before other parts do. This motion may in some embodiments reduce the tendency for the conductive element to become "stuck" in the vicinity of the conductive pad. In some embodiments, the device may be designed such that stable intermediate configurations are obtained in which only a portion of the conductive element is in the vicinity of the conductive pad. Such an embodiment may be used in forming a variable-valued circuit element, as discussed further below.

In a preferred embodiment of the method for forming a micromechanical device, the conductive element is attached to an actuating member of the device, and the variation of the force is in a direction not parallel to the longitudinal axis of the actuating member. The conductive element may in some embodiments be integral to or a part of the actuating member. In an embodiment, the force is a required force for movement of the conductive element toward a conductive pad positioned opposite the conductive element. The conductive element may make contact with the conductive pad during operation of the device, or there may be an insulator between the conductive pad and conductive element, such that they form plates of a capacitor. The force which is varied may also include a force applied to the conductive element during operation of the device, a restoring force tending to pull the conductive element away from a conductive pad, and/or a sticking force between the conductive element and the pad.

In an embodiment, the method may include patterning a first conductive layer arranged over a substrate to form a conductive pad, and patterning a second conductive layer arranged over the first conductive layer to form a conductive element. The patterning of the first conductive layer may include shaping the conductive pad to provide at least a portion of the variation in force across the conductive element. Patterning of the first conductive layer may also form a control element adapted for inducing movement of the conductive element toward the conductive pad. In such an embodiment, the patterning may include shaping the control element to provide at least a portion of the variation in force. Patterning of the second conductive layer may include shaping the conductive element to provide at least a portion of the variation in force. In an embodiment, patterning of the second conductive layer includes forming the actuating member, such as a cantilever arm, containing the conductive element, and shaping the member to provide at least a portion of the variation in force. The member may be shaped in various ways, including by forming openings within the member, where the density of the openings may vary in a direction transverse to the member, or in another direction across the member.

The method may further include forming a sacrificial layer over the first conductive layer and forming the second conductive layer over the sacrificial layer, before patterning the second conductive layer. The sacrificial layer may then be removed after patterning of the second conductive layer. In an embodiment, the upper surface of the sacrificial layer may be contoured before formation of the second conductive layer. Such contouring may allow shaping of a contacting portion of the subsequently-formed conductive element, and the shaping may provide at least a portion of the variation in force across the conductive element.

A method such as that described above may be used to form a switch contemplated herein. The switch is adapted such that a force associated with actuation of the switch varies between locations spaced across a contact element of the switch. In a preferred embodiment, the contact element is attached to an actuating member of the switch, and the variation of the force is in a direction not parallel to the longitudinal axis of the actuating member. The force may include, for example, a required closing force for the switch, an applied force during actuation of the switch, a restoring force tending to open the switch, and/or a sticking force tending to keep the switch closed. The force may in some cases vary monotonically from one side of the contact element to an opposing side of the contact element. In an embodiment, the switch is a cantilever switch, and the force varies in a direction transverse to the arm of the cantilever.

An embodiment of the switch may include the contact element, a contact pad adapted to make electrical contact with at least a portion of the contact element upon closing of the switch, and a control element for inducing movement of the contact element toward the contact pad. The shapes of one or more of these parts of the switch may be adapted to provide at least a portion of the variation in force across the contact element. Such shape adaptation may include asymmetric shapes and/or shapes having openings formed within them.

In addition to the switch described above, a variable-valued circuit element is contemplated herein. The circuit element may include a conductive element, a conductive pad, and a control element for inducing movement of the conductive element toward the conductive pad. The circuit element may be adapted such that a fraction of the conductive element which is moved to the proximity of the conductive pad is variable, depending on a total magnitude of a force applied using the control element. In an embodiment for which an insulator is interposed between the conductive pad and the conductive element, the circuit element may be used as a variable capacitance. In another embodiment, the conductive pad may be divided into multiple separate portions, where the number of portions contacted by the conductive element depends on the force applied using the control element. Each of these portions of the conductive pad may be connected to a respective fixed-value circuit element, so that a variable number of the fixed-value elements may be coupled to the conductive element. The fixed-value circuit elements may include, for example, capacitors, resistors and/or inductors. Each fixed-value circuit element may be connected between its respective conductive pad portion and a terminal common to all of the fixed-value circuit elements, such that those fixed-value elements being coupled to the conductive element are connected in parallel to one another.

In a manner similar to that for the switch and the method discussed above, the variable-valued circuit element may be adapted such that a quantity associated with motion of the conductive element is varied between locations spaced across the conductive element. In a preferred embodiment, the conductive element is attached to an actuating member of the circuit element, and the variation of the quantity is in a direction not parallel to the longitudinal axis of the actuating member. The quantity may include, for example, a force required to induce movement of the conductive element toward the conductive pad, a force applied using the control element, a restoring force tending to pull the conductive element away from the conductive pad, and/or a sticking force tending to keep the conductive element in contact with the conductive pad. The shapes of one or more parts of the circuit element may be adapted to provide some or all of the variation of the quantity.

BRIEF DESCRIPTION OF THE DRAWINGS

Other objects and advantages of the invention will become apparent upon reading the following detailed description and upon reference to the accompanying drawings in which.

Figure 1A:
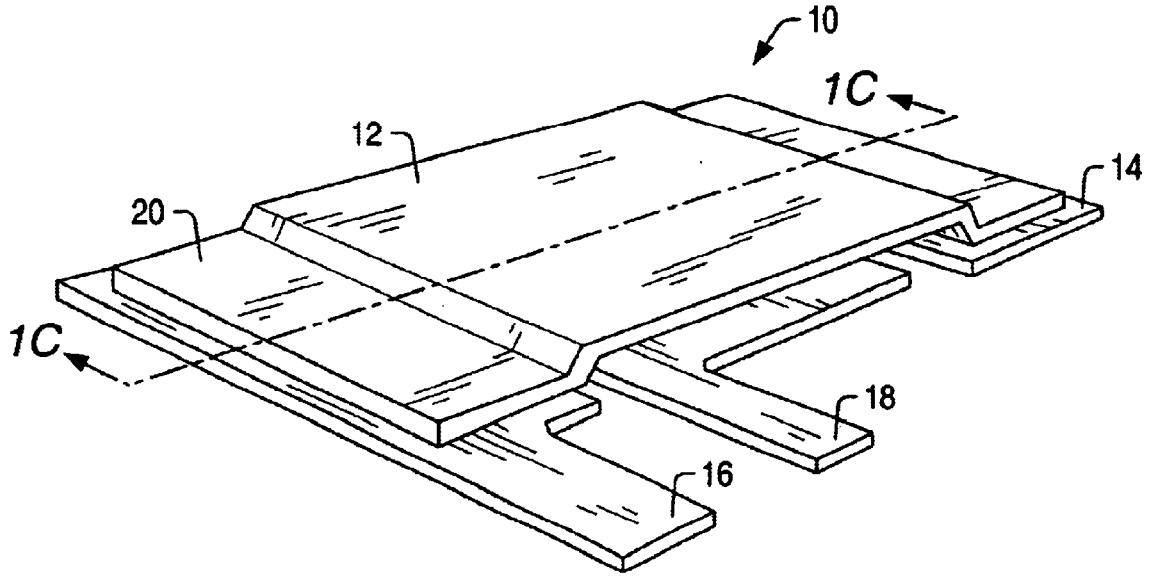
FIG. 1A is a perspective view of a cantilever switch.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

Figure 1B:
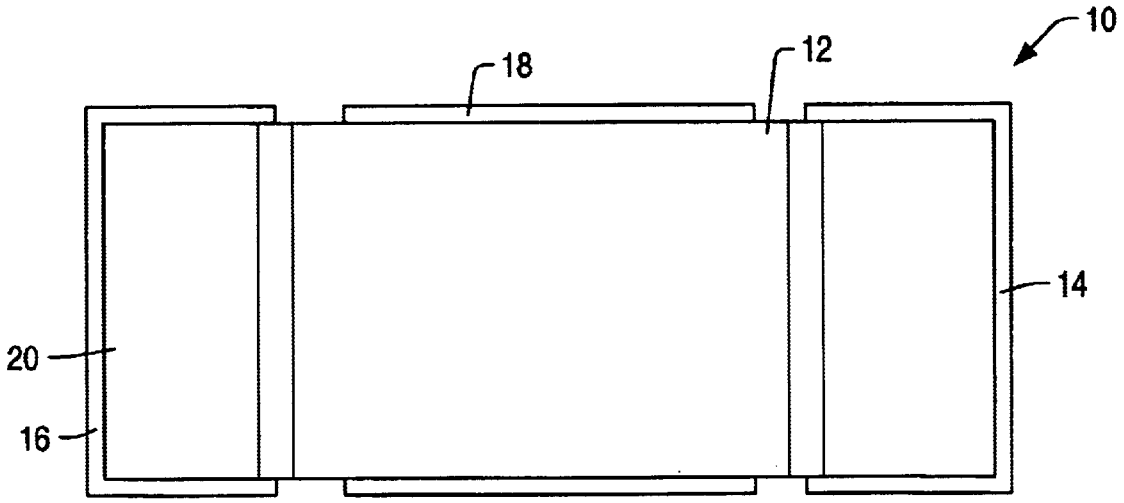
FIG. 1B is a top view of the switch of FIG. 1A.
Figure 1C:
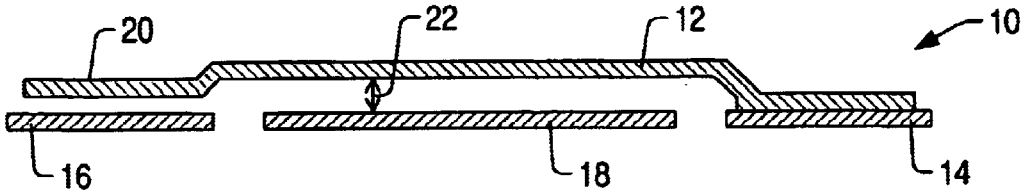
FIG. 1C is a cross-sectional view of the switch of FIG. 1A.
Figure 2:
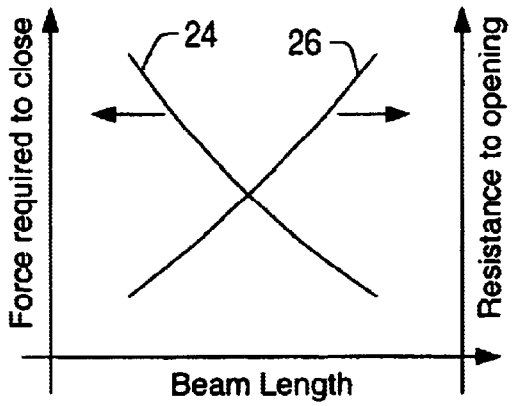
FIG. 2 illustrates trends in opening and closing effectiveness as a function of beam length for the switch of FIG. 1.

The typical tradeoff between opening and closing effectiveness is illustrated for an exemplary electrostatically-actuated MEMS switch using FIGS. 1 and 2. FIGS. 1A, 1B and 1C are perspective, top, and cross-sectional views of MEMS cantilever switch 10. Conductive beam 12 is fixed at one end to contact pad 14. The other end of beam 12 resides a spaced distance above a second contact pad 16 when the switch is open, as in FIG. 1. Gate, or control, electrode 18 underlies beam 12 between the two contact pads. In the electrostatic switch of FIG. 1, application of an electrostatic potential difference between gate electrode 18 and beam 12 creates an attractive electrostatic force between them, causing beam 12 to move downward. Contact element 20 at the end of beam 12 is thereby connected to contact pad 16, so that a signal may be passed between contact pads 14 and 16 along beam 12. The switch remains closed as long as the potential is applied. Upon removing the applied potential, the spring force of the cantilever beam 12 should pull the beam back up, opening the switch. It is noted that in FIGS. 1A and 1C, as well as in the other perspective and cross-sectional views provided herein, the vertical dimensions are exaggerated for illustrative purposes. Gap 22 between beam 12 and electrode 18, for example, may be on the order of a micron. The width of cantilever 12 may be on the order of tens of microns, on the other hand, while the length of the cantilever may be on the order of tens to hundreds of microns.

Because the electrostatic force is relatively weak, a high field (typically on the order of tens of volts applied across a gap 22 on the order of a micron) is needed to close switch 16. As noted above, approaches to lowering the applied voltage needed to close the switch include reducing the gap thickness and reducing the stiffness of the beam. As also discussed above, however, these approaches tend to increase stiction, thereby making the switch less likely to open reliably. An illustration of trends in relative opening and closing effectiveness of a cantilever switch such as that of FIG. 1, as a function of length of the cantilever beam, is shown in FIG. 2. Curve 24 of FIG. 2 indicates that less force is required to close the switch as the beam length is increased, since lengthening the beam is a way of reducing its stiffness and making the unpinned end of the beam easier to pull down. A longer beam may also allow a larger gate electrode to be used, increasing the "electrostatic area" over which the electrostatic force is applied. The reduction in beam stiffness, however, reduces the restoring force of the beam, so that its resistance to opening increases with increasing beam length, as indicated by curve 26. It is noted that curves 24 and 26 are intended only for qualitative illustration, and that no significance is to be applied to the particular shape of the curves, only to their overall directions. Similar trends are observed if variables other than beam length are considered. For example, increasing beam length in FIG. 2 could be replaced with quantities such as decreasing gap spacing, decreasing beam thickness, decreasing beam stiffness, etc.

Figure 3A:
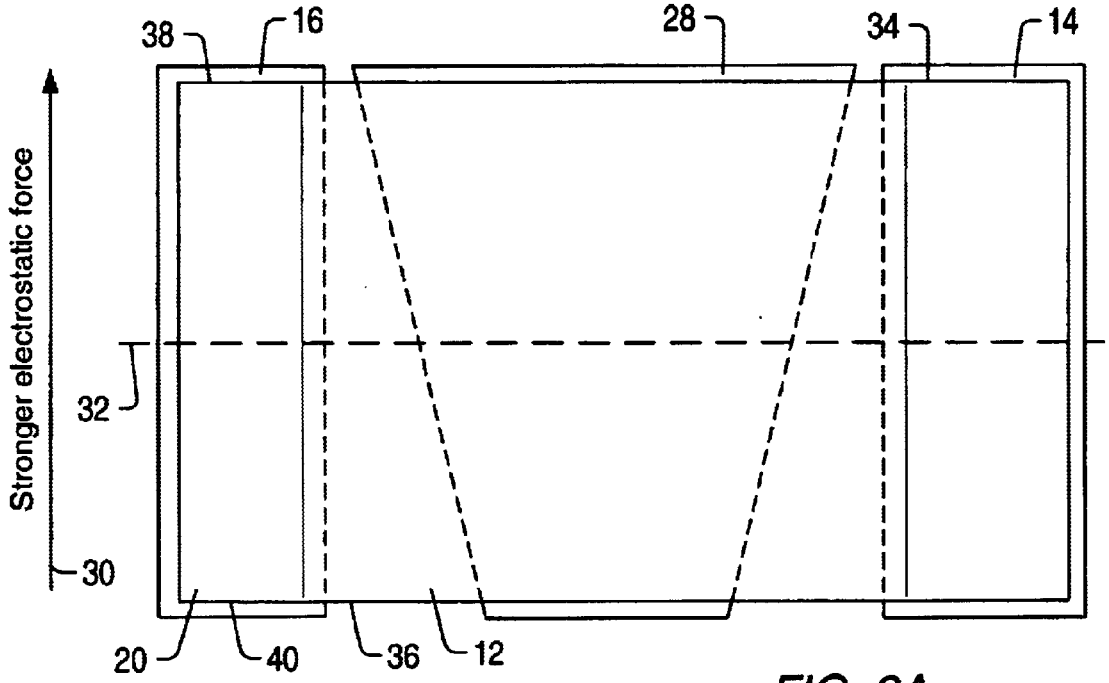
FIG. 3A is a top view of a device having an asymmetric control element.
Figure 3B:
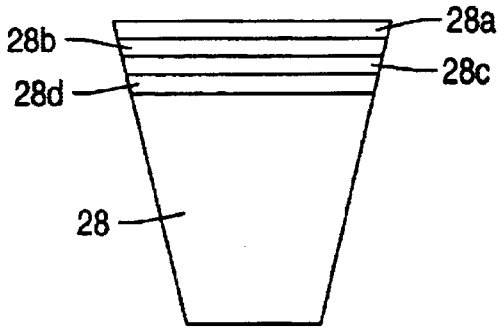
FIG. 3B is a top view of the control element of FIG. 3A showing division of the element into increments.

A top view of an exemplary embodiment of a device having a force varied across its contact element is shown in FIG. 3A. The device in this case is a cantilever switch similar in some respects to switch 10 of FIG. 1. As in the case of switch 10, cantilever beam 12 is pinned at contact pad 14 and connects contact element 20 to contact pad 16 when the switch is closed. Instead of having a rectangular control electrode underlying the beam as in FIG. 1, the switch of FIG. 3A has a control element 28 with length varying in a direction transverse to the beam. In particular, with respect to longitudinal axis 32 of beam 12, the variation in length (defined in the direction of the longitudinal axis) of control element 28 is in a direction transverse to the longitudinal axis. The length variation of element 28 may also be described as a variation in incremental area of the element. As shown in FIG. 3B, element 28 may be divided into equal-width increments 28A, 28B, 28*c*, 28*d*, etc. In the case of a rectangular control element, each of these increments would have the same area. Element 28, on the other hand, has a variation in incremental area in a direction transverse to the longitudinal axis of beam 12. Similarly defined longitudinal axes and area increments may be applied to all of the devices described herein.

Control element 28 is preferably a gate electrode used to apply an electrostatic potential between element 28 and beam 12. The variation in incremental area of element 28 therefore results in a variation in the incremental electrostatic area between the element and the beam. More electrostatic force is therefore applied to beam 12 near edge 34 of the beam (the upper edge in the orientation of FIG. 3A) than near edge 36 (the lower edge), with a smooth variation in between. Arrow 30 illustrates the direction of increasing electrostatic force across beam 12 and, therefore, contact element 20. Application of a potential difference between control electrode 28 and beam 12 may consequently result in a rolling motion for closure of the switch, in which edge 38 of contact element 20 makes contact with contact pad 16 before edge 40 of contact element 20 does. In the embodiment of FIG. 3A, such a rolling motion is believed to result from a variation in the applied force across contact element 20.

Although illustrated in FIG. 3A and other figures herein as applied to a cantilever switch, the methods and structures described herein are applicable to other types of switches and devices. For example, control element 28 of FIG. 3A could underlie a membrane or strap supported at both ends to form a membrane (or strap, or "bridge") device, or element 28 could be used under a "teeter-totter" beam adapted to rock about a central fulcrum. The force variation structures illustrated by other figures included herein may similarly apply to other switches and devices. Although the variation of the length of control element 28 of FIG. 3, and thereby its incremental area, is in a direction transverse to the longitudinal axis of the element, the direction of variation is not limited to this transverse direction. In a preferred embodiment, for the device of FIG. 3 and the other devices disclosed herein, the direction of force variation is in a direction not parallel to the longitudinal axis. (A force variation directed diagonally across a cantilever arm, for example, could be resolved into components including a component parallel to the longitudinal axis, but the resultant direction of the force variation would not be parallel to the longitudinal axis, and there would also be a component not parallel to the longitudinal axis.)

Figure 4A:
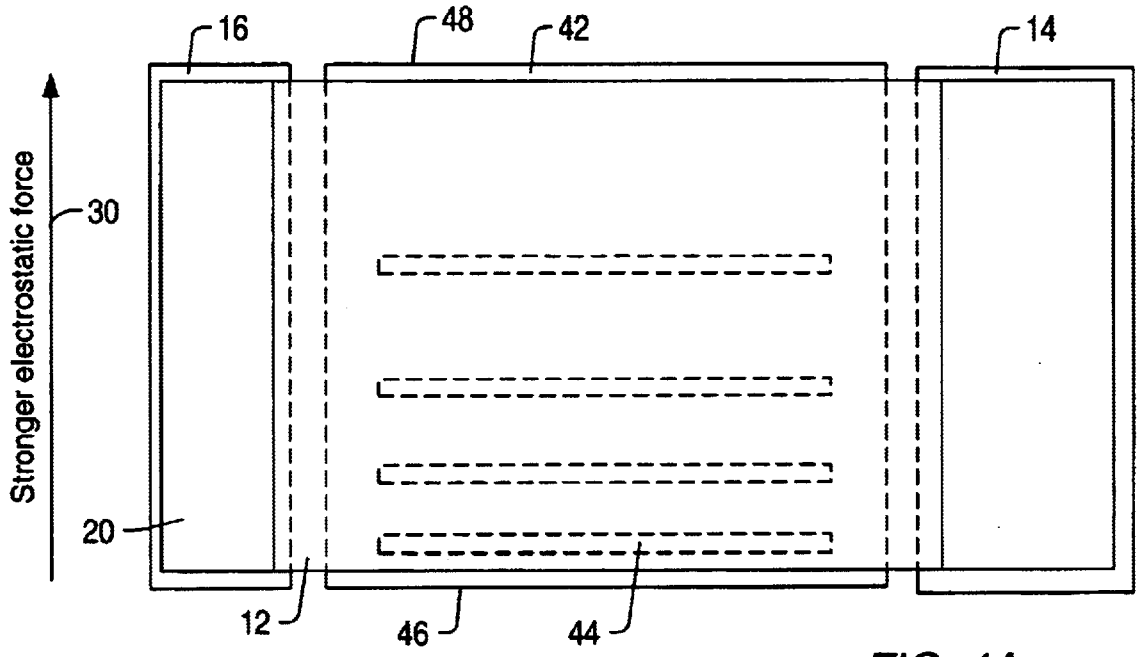
FIGS. 4A and 4B are top views of devices each having a control element with a varied density of openings.
Figure 4B:
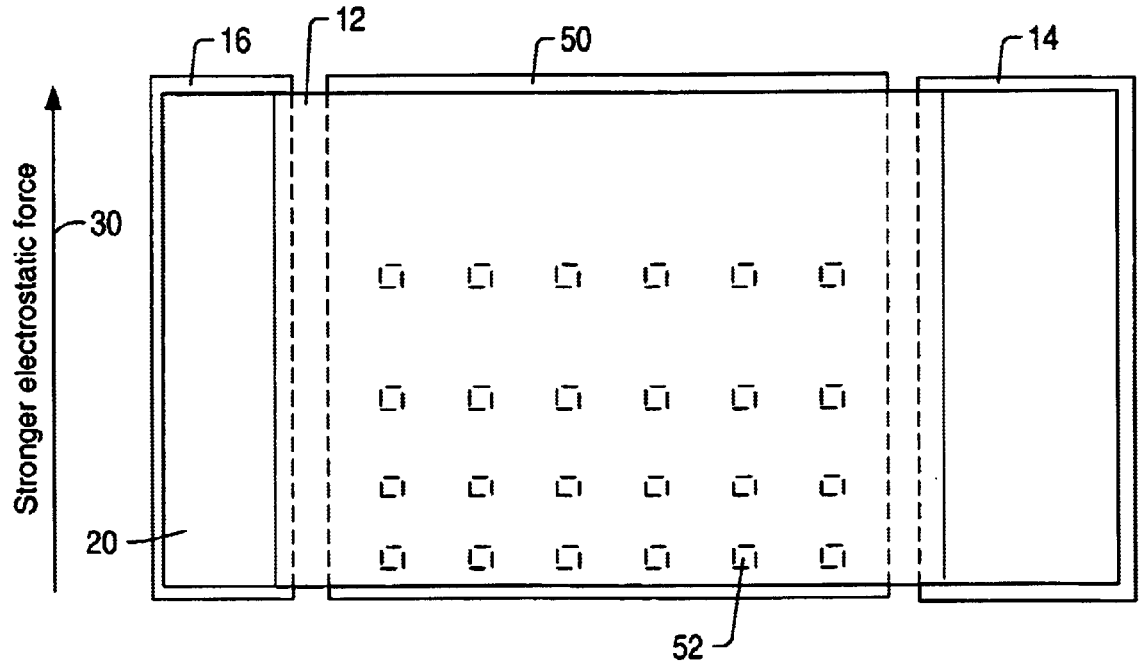

Additional approaches to variation of the incremental electrostatic area of a control electrode are shown in FIG. 4. Control electrode 42 in FIG. 4A includes slots 44. In an embodiment in which electrode 42 is patterned from a conductive layer, slots 44 can be formed by selectively removing the corresponding portions of the conductive layer. Because the slots are spaced closer together near edge 46 of electrode 42, and farther apart moving toward edge 48, the electrostatic area is larger near edge 48 and smaller near edge 46. The applied force on the beam and contact element therefore varies in a direction transverse to the longitudinal axis of beam 12, increasing from the lower edge to the upper edge as shown by arrow 30. FIG. 4B illustrates an approach similar to FIG. 4A, except that the electrostatic area of control electrode 50 is varied using a varied density of openings 52. The opening shapes shown in FIG. 4 are merely exemplary, and innumerable shapes and/or dimensions achievable through microfabrication techniques could be used.

Figure 5A:
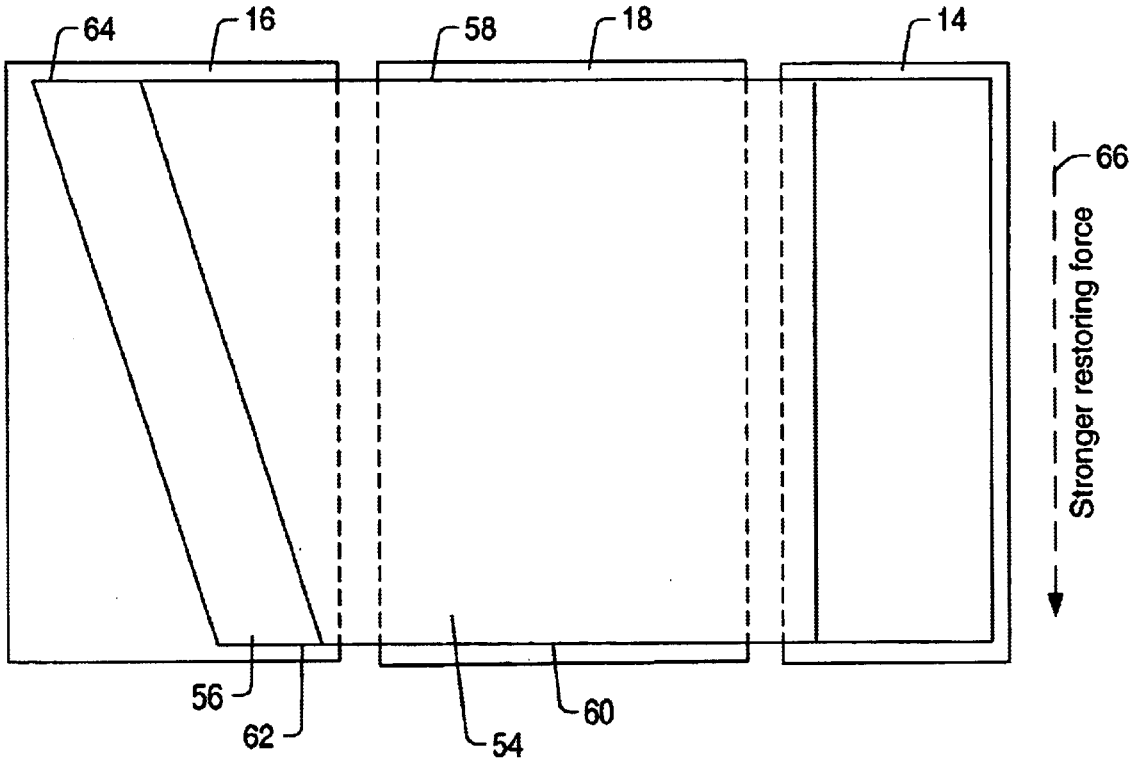
FIG. 5A is a top view of a device with a cantilever arm having its length varied.
Figure 5B:
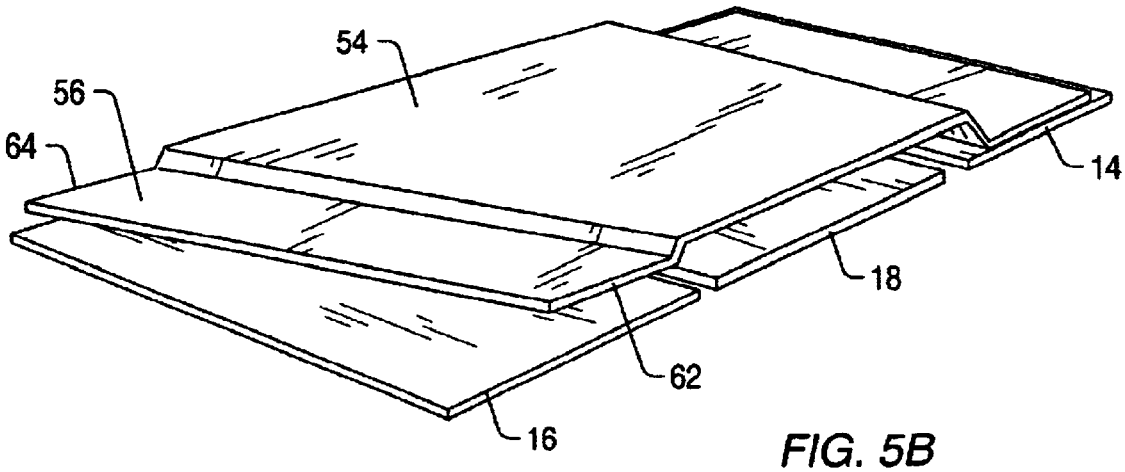
FIG. 5B is a perspective view of the device of FIG. 5A.

As discussed further above, the embodiments of FIGS. 3 and 4 illustrate exemplary ways to provide a variation in applied force across the contact element of a switch or other device. An example of a way to vary a different force is illustrated by FIG. 5. FIG. 5A is a top view, and FIG. 5B a perspective view, of a cantilever switch having a variation in beam length. Contact pads 14 and 16, and control electrode 18 are similar to those of FIG. 1, and are therefore assigned the same respective reference numerals in FIG. 5. The length, along its longitudinal axis, of beam 54 varies in a direction transverse to the longitudinal axis, from longest along edge 58 to shortest along edge 60. The shape of contact element 56 is altered in this embodiment to follow the shape of the beam. In particular, the distance between the contact element and the pinned end of the cantilever is varied across the contact element. This variation in length of the beam or distance from the pinned end is believed to cause beam 54 to behave like a longer beam near edge 58, and a shorter beam near edge 60. The shorter beam is stiffer and has a stronger restoring force, such that the restoring force varies across contact element 56, increasing from edge 64 to edge 62, as shown by dashed-line arrow 66 in FIG. 5A. This variation in restoring force is believed to result in a peeling motion when a potential between control electrode 18 and beam 54 is removed in order to open the switch. The portion of contact element 56 near edge 62 may pull away from contact pad 16 first upon removal of the potential, followed by adjacent portions in turn, and ending with the portion near edge 64.

In addition to the restoring force variation indicated by arrow 66 in FIG. 5A, the beam length variation of FIG. 5 may also provide a variation across the beam of the force required to pull the end of the beam down when closing the switch. The increased length of the beam near edge 58 may make the end of the beam near this edge easier to pull down with a given applied force. This effect is believed to be more likely in the case of switches having relatively small gaps between the contact element and the underlying contact pad. Such a lower required force near edge 58 as compared to the portion of the beam near edge 60 may result in a rolling motion during closing of the switch, in which the portion of contact element 56 near edge 64 makes contact with pad 16 first.

Figure 6:
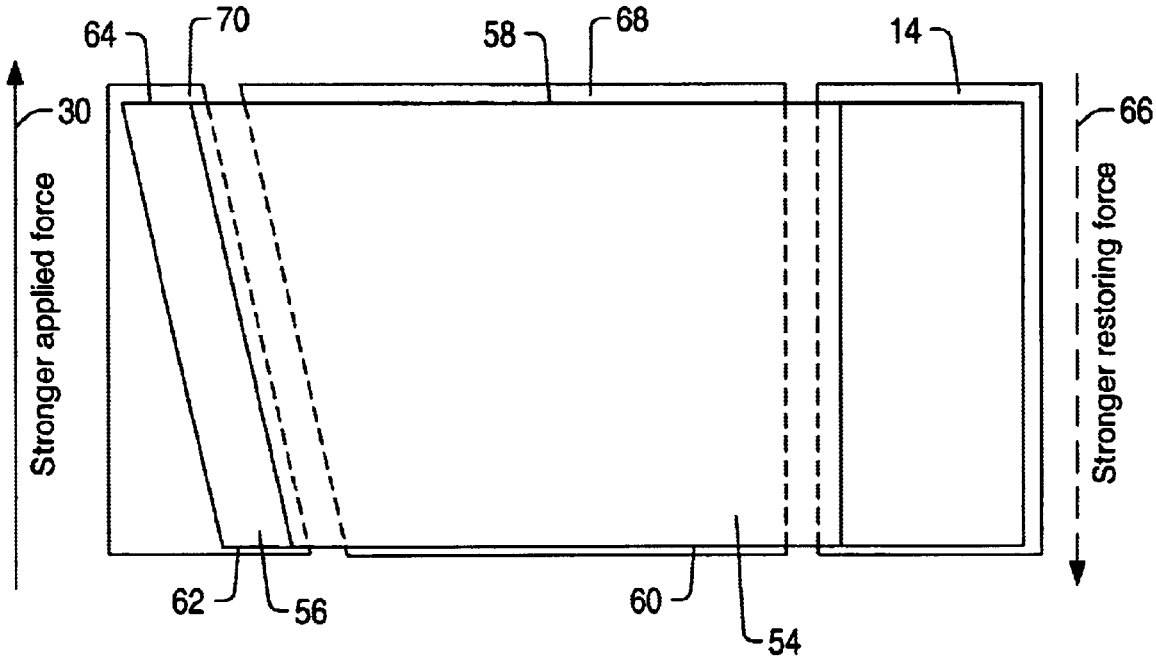
FIG. 6 is a top view of a device having an asymmetric cantilever arm and an asymmetric control element.

The various techniques and structures described herein for providing variation of force across the contact element of a device can generally be combined with one another, as illustrated by the embodiment of FIG. 6. Contact pad 14, asymmetric beam 54 and contact element 56 of the switch of FIG. 6 are similar to those shown in FIG. 5. The embodiment of FIG. 6 also has an asymmetric control element 68 and contact pad 70, however. The length variation of beam 56 results in a restoring force variation similar to that of FIG. 5, as indicated by arrow 66. The variation in electrostatic area provided by the shape of control element 68 gives rise to a variation in applied force similar to that shown in FIG. 3A, as indicated by arrow 30. The combined variations in applied force and restoring force may result in a switch that closes with a rolling motion from edge 64 of the contact element down to edge 62, and that opens with a peeling motion from edge 62 up to edge 64.

The gradual actuation, by rolling and/or peeling, of a switch such as that of FIG. 6 is believed to be advantageous by relaxing somewhat the inverse relationship, such as that shown in FIG. 2 above, typically seen between opening and closing effectiveness of such a switch. A switch such as that of FIG. 6 may exhibit a required closing voltage similar to that of a symmetrical switch having a beam as long as the longer side (along edge 58) of beam 54, while exhibiting an opening effectiveness similar to that of a symmetrical switch having a beam as short as the shorter side (along edge 60) of beam 54. The gradually-actuating design may therefore allow a reduction in closing voltage without as much of the reduction in opening effectiveness which generally accompanies such a closing voltage reduction.

Figure 7:
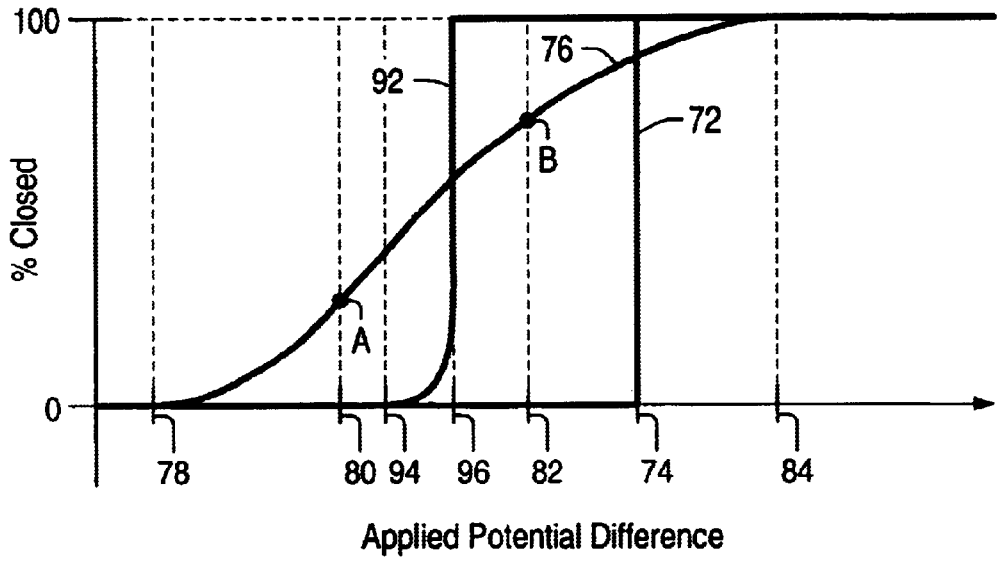
FIG. 7 illustrates exemplary plots of switch closure as a function of applied potential for various electrostatically-actuated switches.

An illustration of exemplary switch closure characteristics as a function of applied force for various electrostatically-actuated switch designs is shown in FIG. 7. The vertical axis indicates percentage closure of the switch, as a function of the applied potential difference, or voltage, along the horizontal axis. The percentage closure refers to the fraction of the contact element which is in contact with a corresponding contact pad (or in some cases with an insulating layer formed over the pad), rather than, for example, the size of a gap between the contact element and the contact pad. Curve 72 is an exemplary characteristic for a symmetric switch, such as that of FIG. 1. Once a sufficient voltage is applied, the switch closes, with the entire contact element coming into the contact with the corresponding contact pad. Curve 72 therefore indicates an abrupt change from zero percent closure to one hundred percent. The required value 74 of applied voltage is dependent on, for example, the dimensions of the switch and properties of the materials used to fabricate it. Curve 76 is an exemplary characteristic for an embodiment of a gradually-actuating switch as described herein, such as those in FIGS. 3, 4 and 6. For this switch, a first portion of the contact element makes contact with the contact pad when a voltage 78 is applied. Voltage level 80 causes about 25% of the contact element area to be in contact with the contact pad, as indicated by point "A" on the curve, while level 82 results in about 75% closure, as indicated by point "B." The switch corresponding to curve 76 becomes completely closed when a potential difference greater than or equal to level 84 is applied.

Figure 8A:
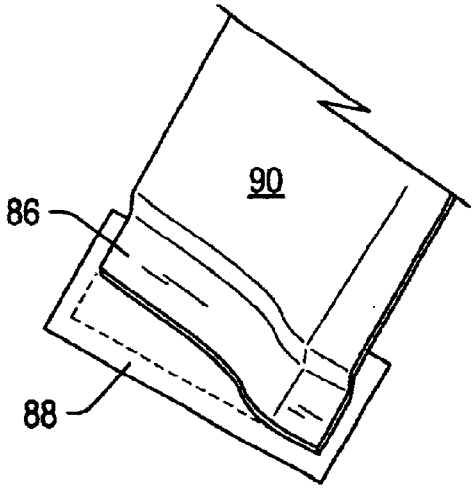
FIGS. 8A and 8B are perspective views of partially-closed switches, corresponding to points "A" and "B," respectively, in the plot of FIG. 7.
Figure 8B:
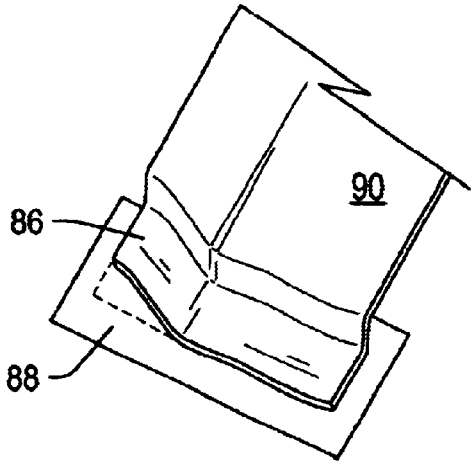

Perspective views of a contact element 86 and corresponding contact pad 88 corresponding to points "A" and "B" of FIG. 7 are shown in FIGS. 8A and 8B, respectively. In FIG. 8A, approximately 25% of contact element 86 is in contact with contact pad 88, while in FIG. 8B, about 75% of element 86 is in contact with pad 88. The dashed lines on contact pad 88 show the position of contact element 86 when the switch is fully closed. As in the case of other perspective views included herein, the vertical scale in the views of FIG. 8 is exaggerated to better illustrate the partial contact formation. Contact element 86 is attached to an actuating member 90, which could be, for example, an arm of a cantilever or teeter-totter switch. The gradual closing shown in FIG. 8 is a result of a variation of one or more forces across contact element 86. The particular structure providing the force variation is not shown in FIG. 8. The force variation could be provided, for example, by a variation in incremental area of a control element (not shown) underlying member 90. Other techniques could also be used instead or in addition, such as variation of the beam length or of the incremental area of the beam (discussed further below).

If the device corresponding to curve 76 in FIG. 7 is to be used as a switch, application of a potential difference at or above level 84 would typically be desirable for closing the switch, in order to induce complete closing as rapidly as possible. In such an embodiment, the configurations shown in FIGS. 8A and 8B occur transiently during the closing of the switch. In an alternative embodiment, however, the device may be used as a variable circuit element. In such a case, application of an intermediate voltage to maintain the device in a partially-closed state may be desirable. Variable circuit element structures are discussed further with respect to FIGS. 14 and 15 below.

Returning to FIG. 7, curve 92 is an exemplary characteristic for another embodiment of a gradually-actuating switch. The switch corresponding to curve 92 begins to close when a voltage of level 94 is applied, and initially closes gradually with increasing voltage applied. When a voltage of level 96 is applied, however, no further applied voltage is needed to bring the switch to 100% closed. In some embodiments of the device described herein having a variation of force across the contact element, opening or closing may proceed "on its own" after an initial "getting started." In particular, a portion of the switch already open or closed may "assist" with the opening or closing of an adjacent portion, which may in turn assist with the next adjacent portion, and so on.

In the case of closing a switch, for example, consider that some initial gap between the actuating member of the switch and a control element generally exists before any voltage is applied. If a voltage sufficient to pull down a first portion of the actuating member, and therefore a first portion of the contact member, is applied, the size of the gap between the first portion of the actuating member and the control element will be reduced. The gap between the control element and a portion of the actuating member immediately adjacent the first portion will accordingly also be reduced (though to a lesser degree). This reduced gap will cause an increase in electrostatic force for a given potential difference between the control element and the actuating member. This increased force may be sufficient to pull down this adjacent portion of the actuating member. The reduction in gap may then propagate across the actuating member, allowing the switch to close entirely, without any increase in voltage applied. Similarly, a device for which some portions of the contact element are initially "stuck" to the contact pad, even after removal of an applied closing force, may be completely opened through "pulling up" of the stuck portions of the actuating member by adjacent open portions of the member.

In the embodiment corresponding to curve 92 of FIG. 7, some increase in applied voltage (the difference between levels 96 and 94) is needed after the switch first begins to close and before the above-described "self-closing" mechanism begins. In other embodiments, however, the self-closing behavior might start as soon as any portion of the contact element had made contact, so that a curve showing percentage closure as a function of applied voltage would resemble curve 72. Without being bound to theory, it is believed that the tendency of a gradually-actuating switch to exhibit the above-described self-closing or self-opening behavior is related to the magnitude of the force variation across the contact element. In particular, designs with more slowly-varying forces are believed to be more likely to exhibit the self-closing or self-opening behavior. Designs in which the force varies more quickly are believed to be more likely to exhibit the stable applied-voltage-dependent closure illustrated by curve 76 of FIG. 7. The nature of the closing behavior is therefore believed to be controllable by design of the force variation.

It is noted that the variations shown in the figures included herein are merely exemplary, and that possibilities for tailoring details of the force variation are limited only by the patterning and other fabrication techniques used to form the devices. Current micromechanical switches, for example, typically have lateral dimensions on the order of tens or hundreds of microns, while patterning techniques common in IC fabrication processes can provide submicron resolution. The capability for tailoring force variations in micromechanical devices is therefore believed to be quite high. For example, the asymmetric shapes for control electrodes, contact pads and/or actuating members described herein need not be formed from straight lines, as shown in the figures. Specific curved shapes could be used instead. Furthermore, the force associated with the device operation does not need to be varied monotonically from one side of the contact element to the other, as shown in the figures, but could be largest or smallest somewhere in the interior of the element, for example.

Figure 9:
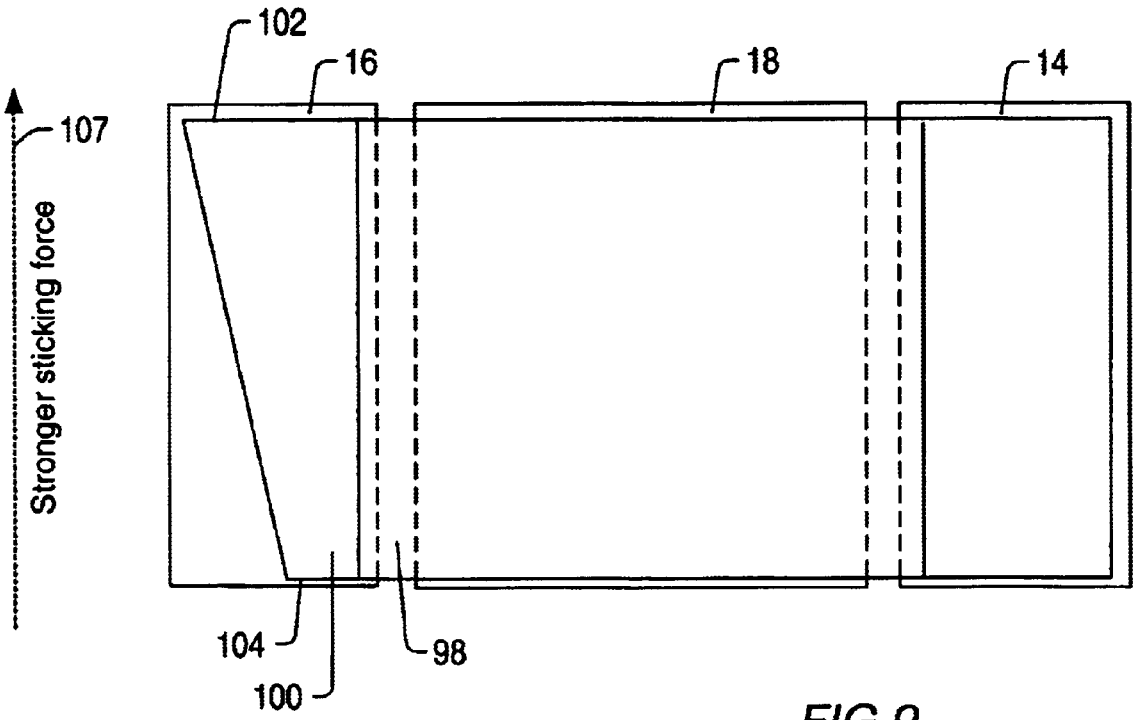
FIG. 9 is a top view of a device having an asymmetric contact area.

Some additional structures giving rise to variations of force across the contact element of a device are shown in FIGS. 9–11. In the embodiment of FIG. 9, contact pads 14 and 16 and control element 18 are similar to those in the switch of FIG. 1. Contact element 100, on the other hand, has an asymmetric shape, with its length varying from longest along edge 102 to shortest along edge 104. By contrast to the switch shown in FIG. 6, the length of beam 98 between the pinned end (over contact pad 14) and contact element 100 is constant. The asymmetry of contact element 100 causes a variation across contact element 100 in the contact area between the contact element and contact pad 16. This variation in contact area is believed to cause a variation in the sticking force, or stiction between the contact element and contact pad. Opening of the switch of FIG. 9 when potential is removed from control element 18 may therefore proceed with a peeling motion, in which edge 104 of contact element 100 pulls away from contact pad 16 first, followed by intermediate portions of the contact element and finally by edge 102. The direction of the sticking force variation is illustrated by dotted-line arrow 107.

Figure 10A:
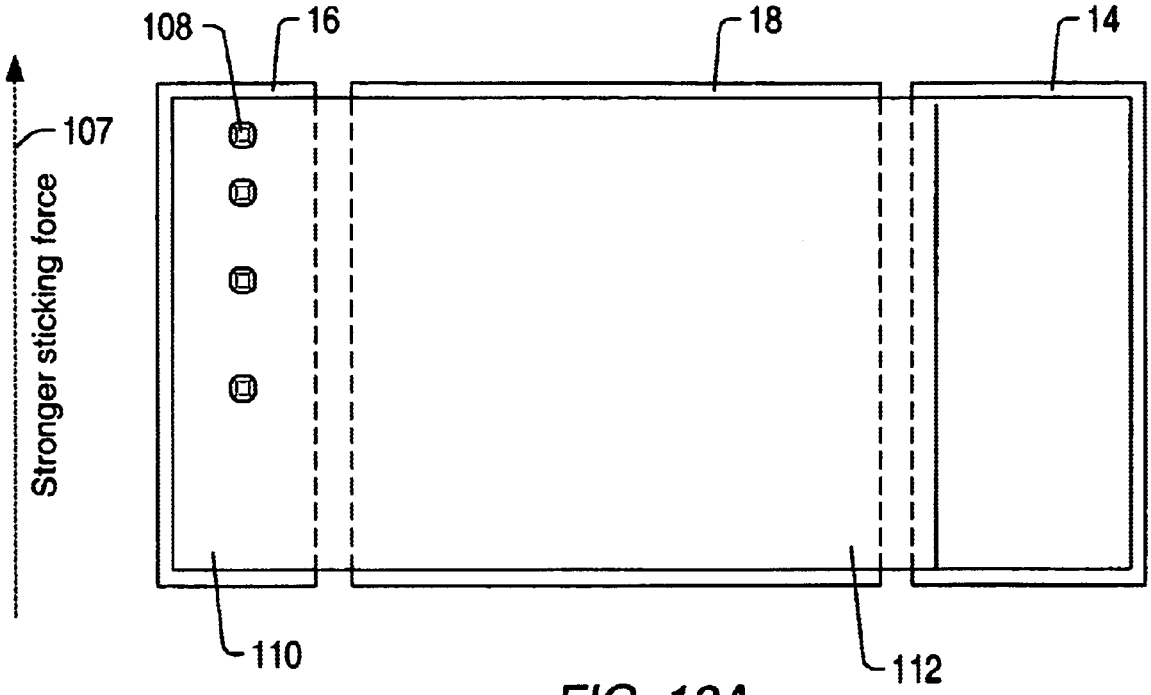
FIGS. 10A and 10B are top views of devices having variable densities of recessed contact area.
Figure 10B:
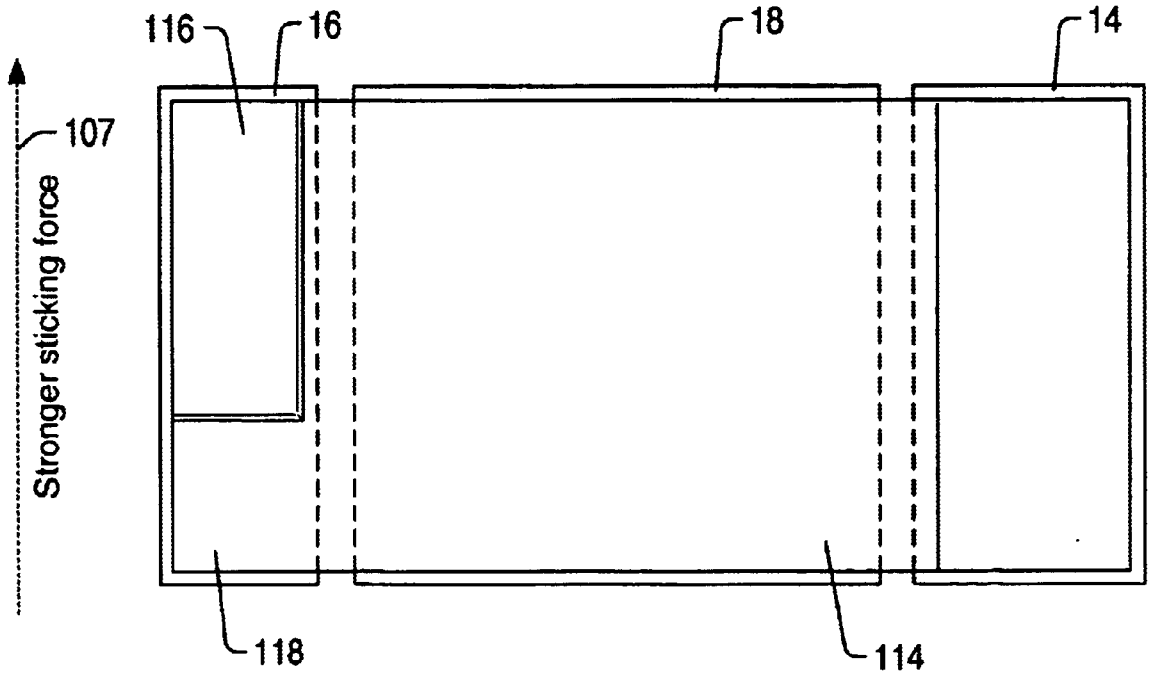
Figure 16:
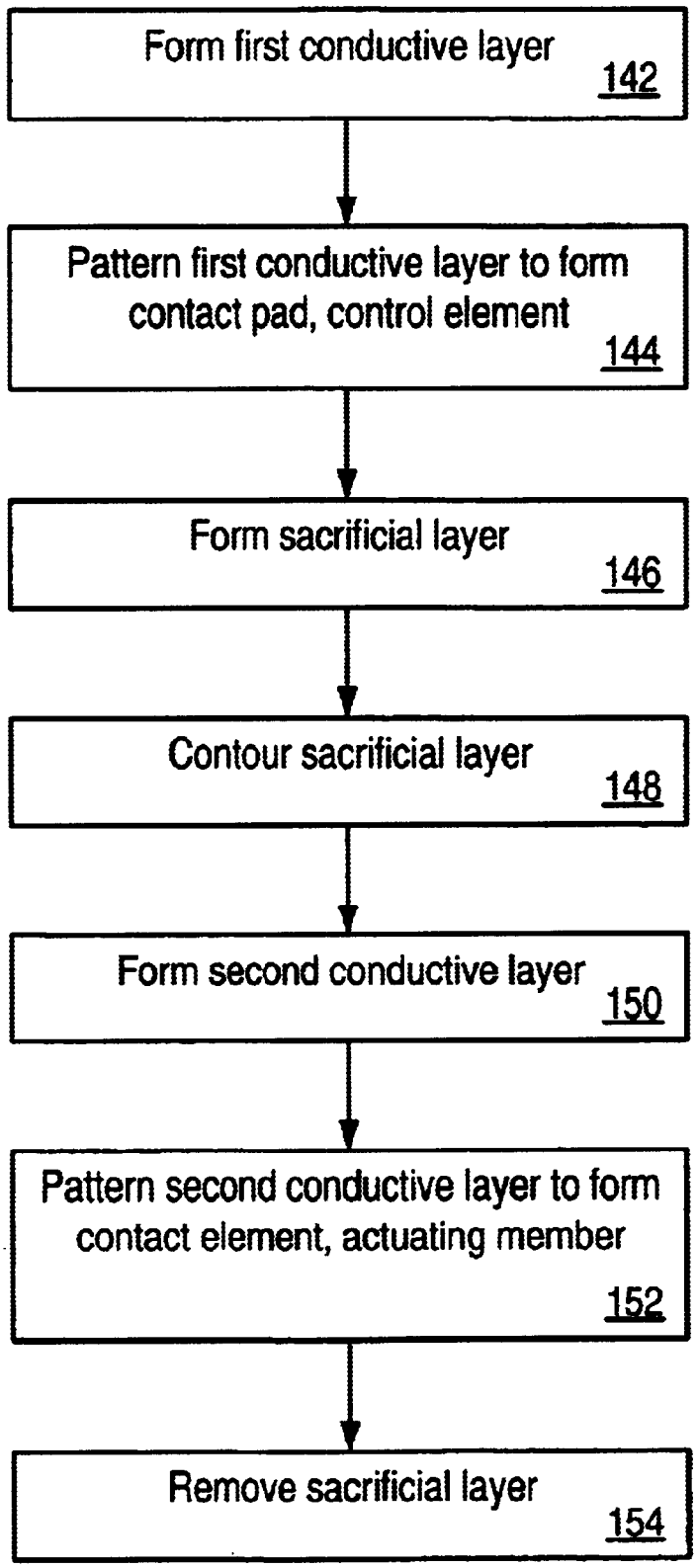
FIG. 16 is a flow diagram illustrating a method of fabricating the devices described herein.

Another way of varying the contact area and thereby the sticking force is illustrated by FIG. 10. In FIG. 10A, dimples 108 are formed within contact element 110. A dimple as used herein is a small recessed portion of the contact element, which extends lower (closer to contact pad 16) than the surrounding contact element area. The recessed portions may be formed to a sufficient depth that only the recessed portions actually make contact with the underlying contact pad when the switch is closed. Variation of the density of dimples 108 in FIG. 10A therefore provides a variation in contact area between contact element 110 and contact pad 16. The increased contact area toward the upper edge of contact element 110 provides an increased sticking force in this direction, as indicated by arrow 107. FIG. 10B is a top view of an embodiment in which a coarser variation in contact area is used. Recessed portion 116 is formed in the upper part of the contact element, while the lower portion 118 of the contact element is not recessed. The recess of portion 116 is preferably of sufficient depth that portion 118 does not ever contact underlying contact pad 16, even when the switch is fully closed. Portion 118 can therefore never "stick" to pad 16, and may help "pull up" recessed portion 116 during opening of the switch. The contact element of FIG. 10B therefore also exhibits a variation in sticking force, albeit a coarse variation, across the contact element. The recessed portions of the contact element shown in FIGS. 10A and 10B may in some embodiments be fabricated through contouring of an underlying sacrificial layer before deposition of a conductive layer subsequently patterned to form the contact element. Fabrication of the devices described herein is discussed further in the description of FIG. 16 below.

As with all of the force variation techniques described herein, other ways of varying the sticking force may be apparent to one of ordinary skill in the art of microfabrication in view of this disclosure. For example, the contact area might also be varied through the use of openings similar to those shown for the control element in FIG. 4, where the openings could be made in the contact element and/or the underlying contact pad. As another example, the contact pad shape could be made asymmetric in a manner similar to that discussed with respect to the contact element in the description of FIG. 9.

Figure 11A:
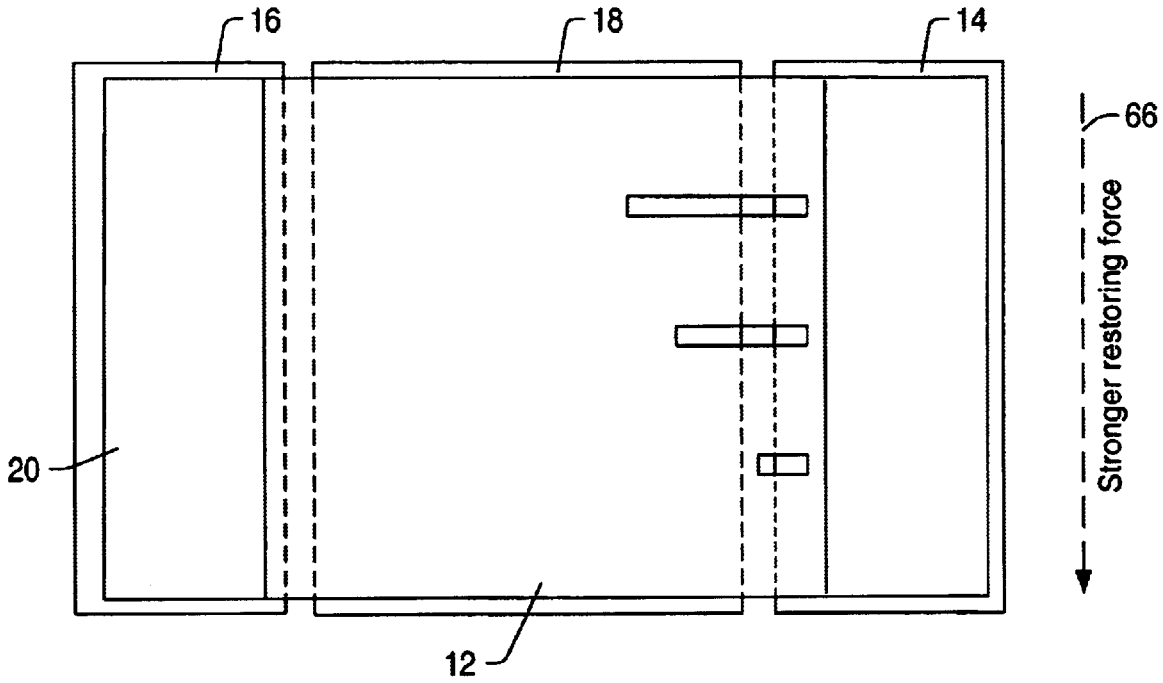
FIG. 11A is a top view of a device having variable-length slots in an actuating member.
Figure 11B:
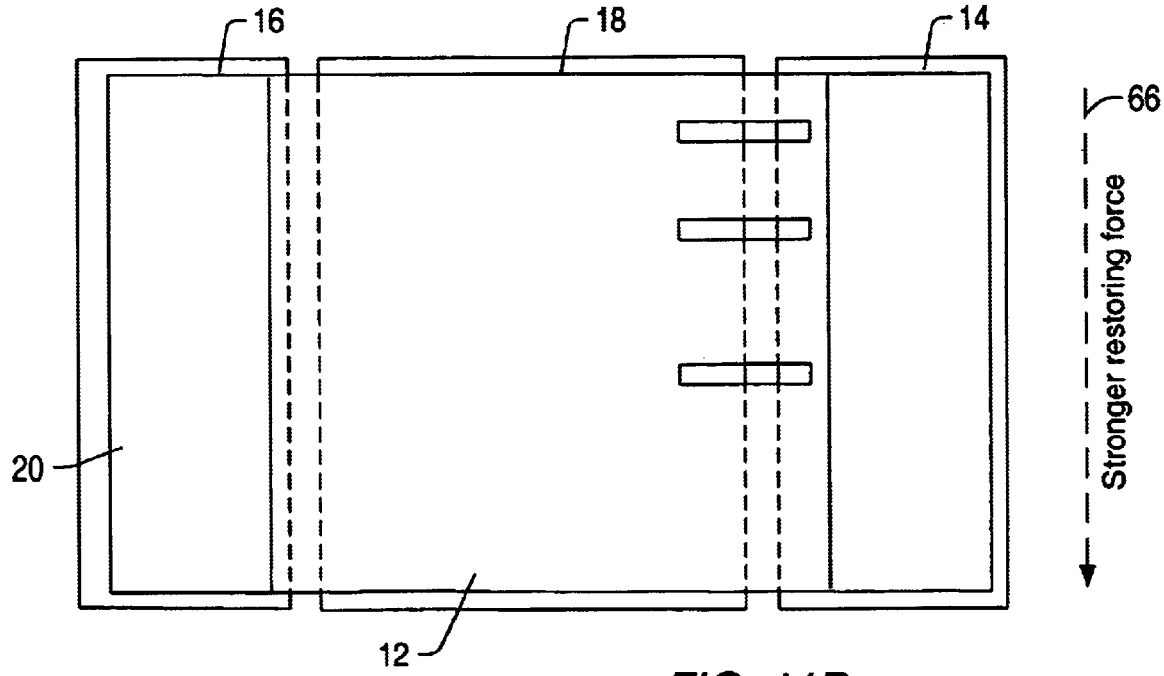
FIG. 11B is a top view of a device having variably-spaced slots in an actuating member.

FIG. 11 illustrates the use of slots within an actuating member, a cantilever beam in this case, to establish a variation in force across the contact element. FIG. 11A is a top view of an embodiment in which variable-length slots are spaced across the actuating member, while FIG. 11B illustrates the use of equal-length slots of varying density. In each case, the reduced stiffness of the member near its upper edge establishes a restoring force variation having a direction indicated by arrow 66. Although the use of openings near the pinned ends of the cantilever arms of FIGS. 11A and 11B is believed to provide a particularly efficient means of varying the beam stiffness, other opening shapes, dimensions and locations within the actuating member may also be used.

Figure 12A:
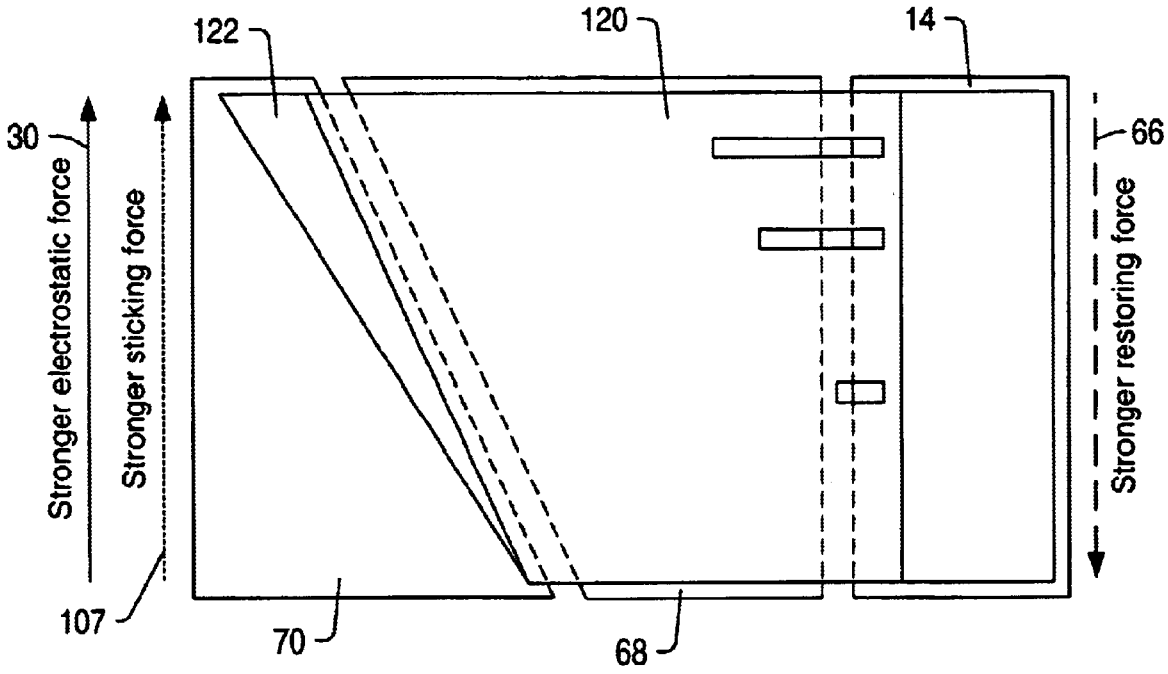
FIG. 12A is a top view of a device having asymmetric control element and contact areas, as well as a varying arm length and a variable density of slots within the arm.
Figure 12B:
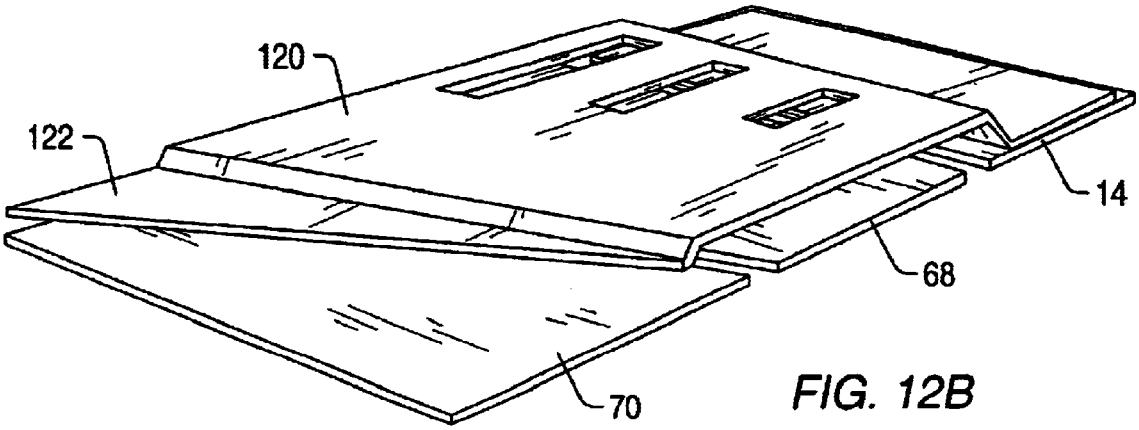
FIG. 12B is a perspective view of the device of FIG. 12A.

A switch embodiment combining multiple of the above-described force variation structures is shown in FIG. 12. FIG. 12A is a top view, and FIG. 12B a perspective view of the switch. Control element 68 and contact pad 70 are similar to those shown in FIG. 6, while beam 120 includes variable-length slots in the manner of the beam of FIG. 11A. In addition, contact element 122 has an area variation similar to that of the contact element shown in FIG. 9. These variations combine to provide an applied force variation in the direction indicated by arrow 30, a restoring force variation in the direction of arrow 66, and a sticking force variation in the direction indicated by arrow 107. For the switches shown in FIG. 6 and FIG. 12, it can be seen that the forces tending to close the switch or keep it closed (e.g., applied force, sticking force) tend to vary in the opposite direction as the forces tending to open the switch or keep it open (e.g., restoring force). This may be a desirable arrangement with regard to preventing the forces from "working against" one another. However, this relationship may not necessarily hold for every device embodiment, particularly when combinations of force variation structures are employed.

Figure 13A:
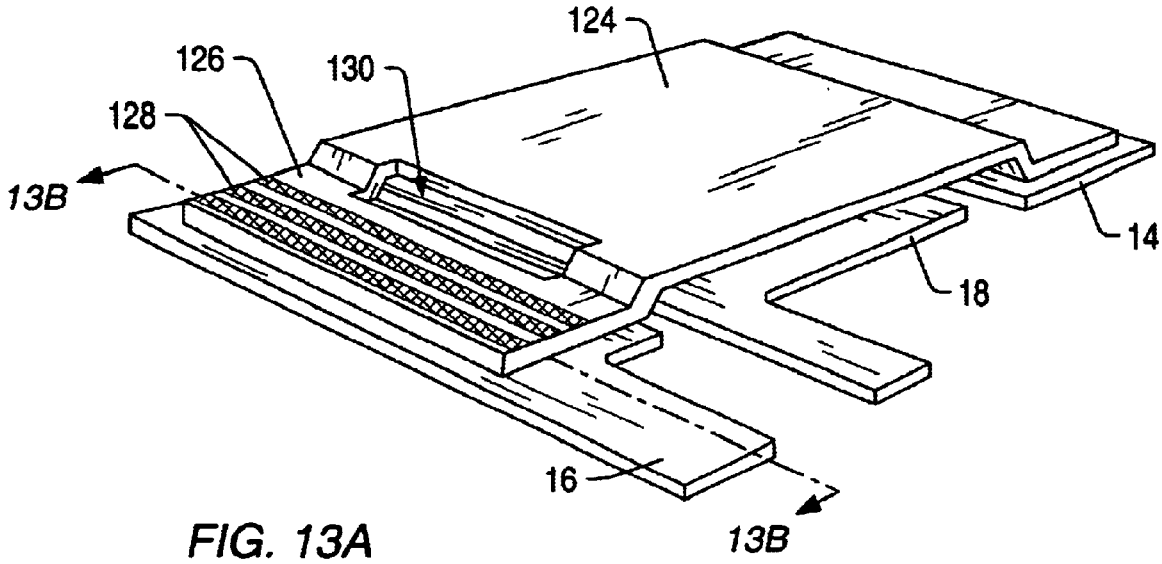
FIG. 13A is a perspective view of a device having a pre-stressed contact element.
Figure 13B:
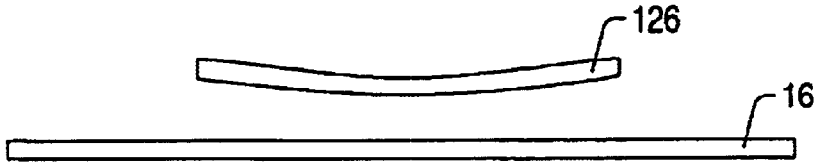
FIG. 13B is a cross-section of the contact element of FIG. 13A.

Still another approach to providing a force variation across the contact element of a device is shown in FIG. 13. FIG. 13A is a perspective view of a switch including a pre-stressed contact element 126. Contact element 126 is stressed prior to (and independently of) operation of the switch through the use of stressor lines 128 on the upper surface of element 126. The stressor lines are made of a material which is tensile stressed with respect to the underlying contact element. This may be achieved in some embodiments by depositing the contact material under conditions that produce lower tensile stresses and then depositing the material that makes the stressor lines under conditions that produce relatively higher tensile stresses. Methods for adjusting film stresses may include, without being limited to, depositing films at different rates, varied temperatures, varied compositions, varied pressures, under various surface conditions such as plasma or ion bombardment, under exposure to various radiations, under exposure to various acoustic energies, and/or with the use of varied reactant mass transport rates. If the contact element is formed from gold, for example, chromium, which can be deposited with a tensile stress magnitude larger than that of gold, may be a suitable choice for the stressor lines. A cross-section of the contact element and underlying contact pad along cut B—B is shown in FIG. 13B. As can be seen in the cross-section, the tensile stress applied by stressor lines 128 pulls up the outer ends of contact element 126. When the switch is closed, therefore, the central portion of contact element 126 makes contact with pad 16 first, followed by the outer portions. When the switch is opened, the tensile stress is believed to cause the outer ends of the contact element to pull away from pad 16 first, followed by the central portion. The stressing of the contact portion therefore establishes a variation in restoring force, increasing going from the center to the outer edges of the contact element. Furthermore, a variation in force required to close the switch is varied across the contact element, increasing from the outer edges to the center.

The arrangement of stressor lines 128 in FIG. 13A is merely exemplary, and a different configuration of stressor material could be used. In the embodiment of FIG. 13A, an opening 130 is included in beam 124 at the edge of conductive element 126. Such an opening may help to decouple the contact element from the rest of the beam, allowing the stressor lines to more readily deform the contact element. Such a decoupling could be done differently in some embodiments, for example by leaving the central portion of the beam intact and removing portions at the outer edges of the beam on each side. As with the other force variation structures described herein, the stressed contact element of FIG. 13 could in some embodiments be combined with other force variation structures. For example, the electrostatic area between beam 124 and control element 18 could be varied by tailoring the shape of control element 18. In a preferred embodiment, such additional variations could be designed to make restoring force stronger at the edges of the contact element, and/or make applied force stronger at the center of the element.

Figure 14:
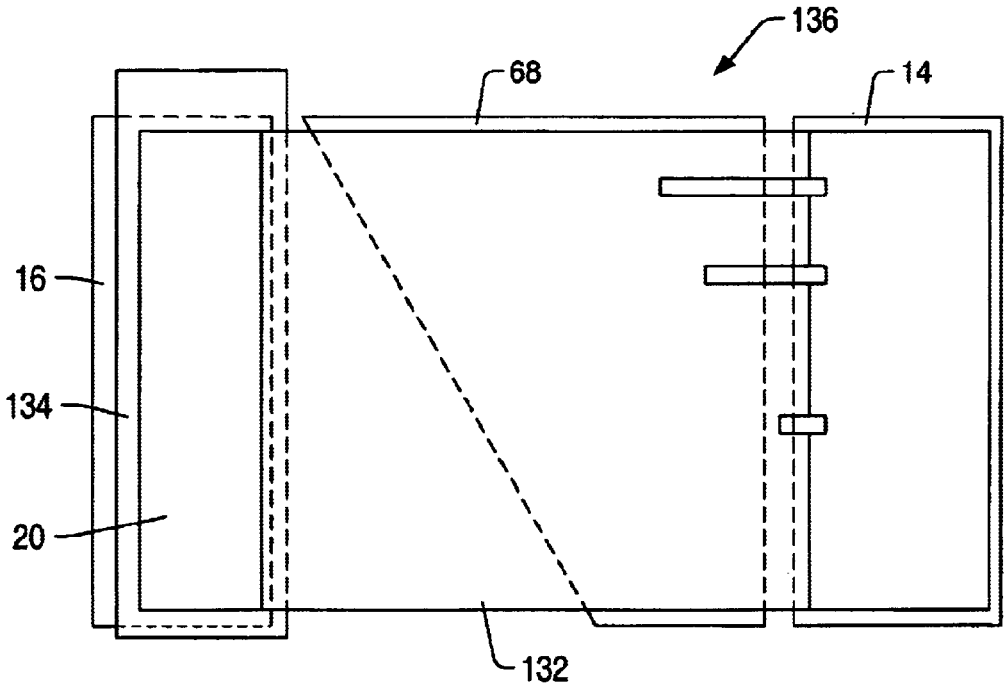
FIG. 14 is a top view of a variable capacitor embodiment.
Figure 15:
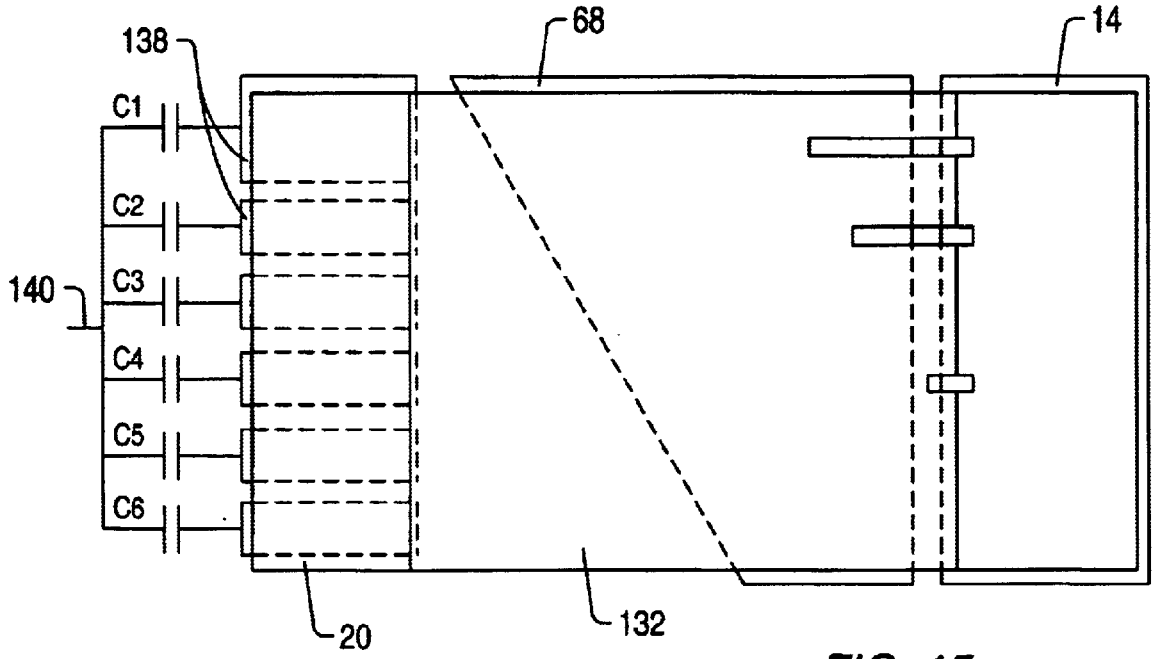
FIG. 15 is a top view of a variable capacitor embodiment having multiple contact pad portions and corresponding fixed-value elements.

The above-described examples have used switch designs to illustrate force variation structures. A device having a variation in force across the contact element may also be used as a variable circuit element, as shown by the embodiments of FIGS. 14 and 15. In FIG. 14, the inclusion of insulating layer 134 between contact pad 16 and contact element 20 forms a variable capacitor 136 from a cantilever switch having force variations across the contact pad. In the embodiment of FIG. 14, the force variations present include a restoring force variation caused by the variable length slots in beam 132, and an applied force variation resulting from an electrostatic area variation caused by the asymmetric shape of control element 68. Considering the closure versus applied potential characteristics of FIG. 7, at least a portion of the characteristic for variable capacitor 136 must have a variation such as that of curve 76 in FIG. 7. In other words, the element must be designed such that one or more intermediate levels of force applied using control element 68 result in corresponding stable, partially-closed configurations of the device. There should therefore be one or more applied force levels for which the self-closing and/or self-opening behavior described above does not occur. As noted above, this behavior is believed to be controllable by tailoring the rate of force variation across the contact element.

In the embodiment of FIG. 15, no insulating layer is included between the contact element and underlying contact pad, but the contact pad is divided into multiple electrically isolated portions 138. Depending on the potential difference applied between control element 68 and beam 132, a variable number of these pad portions are in contact with contact element 20 (and therefore with each other). Separate fixed-value elements, in this case capacitors C1 through C6, may be connected to the respective pad portions. Opposite ends of the fixed-value elements may be connected together to form a common output terminal 140. Connection of pad portions 138 to conductive element 20 therefore connects the corresponding fixed-value elements in parallel with each other. In this way, a variable capacitor may be formed having a wider range of values than may be available for the parallel-plate design of FIG. 14. Other fixed-value elements, such as resistors or inductors, could be used in place of the capacitors of FIG. 15 to form other types of variable circuit element. In some embodiments, different types of fixed value elements could be used within a device (e.g., capacitors connected to some of pad portions 138 while resistors are connected to other pad portions).

An exemplary embodiment of a method which may be used to form a device such as the gradually-actuating switches or variable circuit elements described above is shown in FIG. 16. It is noted that the methods and structures described herein are believed to also be applicable to devices other than switches and variable circuit elements. Other types of micromechanical devices involving motion, such as movable mirrors or flow controllers, may also benefit from variation of a force across a conductive element. In the method shown in the flow diagram of FIG. 16, a first conductive layer is formed (box 142), preferably on some sort of insulating substrate. The substrate may include a semiconductor substrate, for example, or an insulating layer formed over a conducting or semiconducting substrate. The conductive layer may be formed using various techniques, including chemical vapor deposition, physical vapor deposition techniques such as evaporation or sputtering, and electrochemical plating, or combinations of such methods. A suitable thickness for the first conductive layer may be approximately a few microns, although thinner or thicker layers could be used depending on the particular materials and process used.

The first conductive layer may then be patterned (box 144) to form one or more contact pads and control elements. For example, contact pads such as pads 14 and 70 of FIG. 12A may be patterned from such a conductive layer, as well as a control element such as element 68 of FIG. 12A. The patterning may be achieved using, for example, lithography and etching techniques such as would be apparent to those of ordinary skill in the art of microfabrication in view of this disclosure. Depending on the particular device being formed, the arrangement of contact pads and control elements may vary from that of FIG. 12A. The control elements shown in the figures are preferably control electrodes for electrostatically actuated movement, but other forms of actuation are possible and contemplated. For example, an actuating member could be made from a magnetic material, and a coil used as a control element in the case of a magnetically-actuated device. In some magnetically-actuated embodiments, a flat coil could be patterned from the first conductive layer of FIG. 16 in place of an electrostatic control electrode. The applied magnetic force generated may vary across the surface of such a flat coil, thereby providing a form of force variation. Other force variation structures described herein, such as adaptations of the shape of the actuating member or the contact pad, may also be suitable for use with magnetic actuation. Other types of actuation, such as thermal actuation in which moving elements include materials of dissimilar thermal expansion coefficient, may also be compatible with at least some of the force variation structures described herein. For example, the structures described for variation of the restoring force of an actuating member may be compatible with thermal actuation. Depending on the form of actuation used, therefore, the patterning of the first conductive layer may or may not include formation of a control element as described in FIG. 16.

The patterning of the first conductive layer described above may be used to implement several of the force variation structures discussed herein. For example, this patterning may control the shape of any conductive pads and/or control elements being formed, and may be used to form openings within such a pad or control element.

A sacrificial layer may then be formed over the patterned first conductive layer, as indicated in box 146 of FIG. 6. Such a sacrificial layer may be used to support elevated portions of the device during fabrication. The layer material may be conductive or insulating, and may be chosen based on criteria such as its ease of patterning or contouring, and/or its ability to be etched away without damage to surrounding structures. The sacrificial layer may then be contoured (box 148) prior to formation of overlying layers. "Contouring" as used herein may include forming openings through the sacrificial layer in which interconnection or support structures may be formed, as well as forming shallower depressions in the upper surface of the sacrificial layer. Such shallower depressions may be useful in creating recessed portions such as "dimples" in subsequently-formed overlying elements. Contouring of the sacrificial layer may therefore be used in implementing force variation structures as described herein. For example, a variable density of recessed portions of a conductive element could be formed. The contouring may be done using techniques similar to those used for patterning the first conductive layer, with appropriate adjustments to account for any differences in the materials being patterned and/or removed. A suitable thickness for the sacrificial layer when formed may be on the order of a few microns, although contouring may result in thicknesses of less than one micron in some areas of the device.

A second conductive layer may then be formed over the contoured sacrificial layer (box 150). The layer may be formed using methods similar to those described above for the first conductive layer formation. Preferred thicknesses of the second conductive layer may range from about 1 micron to about 10 microns, depending on the stiffness of the material used. The second conductive layer may then be patterned (box 152) to form one or more contact elements and actuating members (such as a beam or membrane) for the device. In the figures included herein, a conductive element has been illustrated as a recessed portion of a conductive actuating member, such that a signal may be connected from one contact pad to another through the actuating member and conductive element. Such a configuration is not required by the structures and methods described herein, however. In some embodiments, for example, at least a portion of the actuating member could be insulating, and a contact pad such as pad 14 of FIG. 12A could be electrically isolated from a pad such as pad 70 of FIG. 12A, even with each pad in contact with one end of the actuating member. This configuration may be useful in embodiments for which the conductive element itself is positioned to bridge a gap between more than one conductive pad, thereby connecting multiple pads together. In an embodiment such as this, the patterning of the second conductive layer might form the conductive element but not the entire actuating member. An additional layer formation and patterning might then be used to complete the actuating member. Patterning to form a conductive element and/or actuating member may be used to implement various force variations across the conductive element of a device. As noted above, the patterning may be used to control an element's shape or to form a desired variation of opening density within an element.

After formation of the contact element and actuating member, the sacrificial layer may be removed (box 154), thereby freeing the actuating member for motion in response to the appropriate applied force. The steps described above may not include all steps used in forming the micromechanical device, and certainly do not include all steps used in forming a typical circuit containing such a device. The above-described steps may be combined with other steps used for, e.g., transistor fabrication in forming a complete circuit. Further steps may include those relating to, e.g., interconnection, passivation, and packaging of a circuit.

It will be appreciated to those skilled in the art having the benefit of this disclosure that this invention is believed to provide a device in which a force associated with operation of the device is varied across a contact element of the device, and a method for forming such a device. Further modifications and alternative embodiments of various aspects of the invention will be apparent to those skilled in the art in view of this description. For example, other types of force variation, such as variation in the thickness of an actuating member, may be apparent in view of this disclosure. Such a thickness variation, for example, could be formed by repeated deposition and patterning of portions of the actuating member, and forming a force variation in an actuating member could generally be described in terms of varying an incremental volume of the actuating member. It is intended that the following claims be interpreted to embrace all such modifications and changes and, accordingly, the specification and drawings are to be regarded in an illustrative rather than a restrictive sense.

What is claimed is:

1. A switch comprising a contact element attached to an actuating member, wherein a force associated with actuation of the switch increases from one side of the contact element to an opposing side of the contact element, and wherein a variation of the force is directed along an angle having an absolute value less than 180 degrees with respect to a longitudinal axis of the actuating member.

2. The switch of claim 1, wherein the actuating member comprises an arm of a cantilever switch.

3. The switch of claim 1, wherein the actuating member comprises a strap or membrane supported at each end of its longitudinal axis.

4. The switch of claim 1, wherein the contact element is integral with the actuating member.

5. The switch of claim 1, wherein the force associated with actuation of the switch comprises an applied force during actuation of the switch.

6. The switch of claim 5, wherein the applied force comprises an electrostatic force.

7. The switch of claim 5, wherein the applied force comprises a magnetic force.

8. The switch of claim 1, wherein the force associated with actuation of the switch comprises a restoring force tending to open the switch.

9. The switch of claim 1, wherein the force associated with actuation of the switch comprises a sticking force tending to keep the switch closed.

10. The switch of claim 1, comprising:

the contact element;

a contact pad adapted to make electrical contact with at least a portion of the contact element upon closing of the switch; and a control element for inducing movement of the contact element toward the contact pad.

11. The switch of claim 10, wherein the control element is configured to provide at least a portion of the variation of force across the contact element.

12. The switch of claim 11, wherein an incremental area of the control element is varied across the control element.

13. The switch of claim 12, wherein the control element underlies the actuating member, and wherein a length of the control element along the longitudinal axis of the actuating member varies along a direction transverse to the longitudinal axis.

14. The switch of claim 10, wherein a contacting portion of the contact element is configured to provide at least a portion of the variation of force across the contact element.

15. The switch of claim 14, wherein the contacting portion of the contact element is pre-stressed to extend a first portion of the contacting portion closer to the contact pad than a remaining portion of the contacting portion.

16. The switch of claim 14, wherein an incremental area of the contacting portion is varied across the contact element.

17. The switch of claim 16, wherein the contacting portion of the contact element comprises one or more recessed portions of the contact element.

18. The switch of claim 10, wherein the contact pad is formed having an asymmetric shape to provide at least a portion of the variation of force across the contact element.

19. The switch of claim 1, wherein the actuating member is configured to provide at least a portion of the variation of force across the contact element.

20. The switch of claim 19, wherein an incremental volume of the actuating member is varied in a direction other than that of the longitudinal axis of the actuating member.

21. The switch of claim 20, wherein a length of the actuating member is varied.

22. The switch of claim 20, wherein a density of openings within the actuating member is varied.

23. The switch of claim 22, wherein the openings comprise slots or holes.

24. The switch of claim 20, wherein a thickness of the actuating member is varied.

25. A switch comprising:

an actuating member;

a contact element attached to the actuating member, wherein a force associated with actuation of the switch increases from one side of the contact element to an opposing side of the contact element, and wherein a direction of variation of the force is transverse to a longitudinal axis of the actuating member;

a contact pad adapted to make electrical contact with at least a portion of the contact element upon closing of the switch; and a control element for inducing movement of the contact element toward the contact pad, wherein the variation of force causes consecutive portions of the contact element to move towards the contact pad in a rolling motion.

26. A switch having a plurality of components comprising:

an actuating member;

a contact element attached to the actuating member;

a contact pad adapted to make electrical contact with at least a portion of the contact element upon closing of the switch; and a control element for inducing movement of the contact element toward the contact pad;

wherein at least one of the plurality of components is asymmetrically formed along a direction transverse to a longitudinal axis of the actuating member, and wherein the asymmetrical form causes a variation of force across the contact element along the transverse direction.

* * * * *

UNITED STATES PATENT AND TRADEMARK OFFICE

CERTIFICATE OF CORRECTION

PATENT NO. : 6,707,355 B1
DATED : March 16, 2004
INVENTOR(S) : Yee

It is certified that error appears in the above-identified patent and that said Letters Patent is hereby corrected as shown below:

Column 15,
Lines 23-26, Claim 1, should read as follows:
A switch comprising a contact element attached to an actuating member, wherein a force associated with actuation of the switch increases from one side of the contact element to an opposing side of the contact element, and wherein a configuration of the switch causes a variation of the force in a direction not parallel to a longitudinal axis of the actuating member.

Column 17,
Line 7, after the phrase "the switch" please delete "and."
Line 9, after the phrase "contact pad" please insert -- and --.

Signed and Sealed this

Twenty-eighth Day of September, 2004

JON W. DUDAS
*Director of the United States Patent and Trademark Office*